US009411352B1

(12) United States Patent
Sung

(10) Patent No.: US 9,411,352 B1
(45) Date of Patent: Aug. 9, 2016

(54) TRIMMING CIRCUIT AND SEMICONDUCTOR SYSTEM INCLUDING THE SAME

(71) Applicant: SK hynix Inc., Icheon-si, Gyeonggi-do (KR)

(72) Inventor: Moon Soo Sung, Seoul (KR)

(73) Assignee: SK hynix Inc., Icheon-si, Gyeonggi-do (KR)

( * ) Notice: Subject to any disclaimer, the term of this patent is extended or adjusted under 35 U.S.C. 154(b) by 0 days.

(21) Appl. No.: 14/797,612

(22) Filed: Jul. 13, 2015

(30) Foreign Application Priority Data

Mar. 4, 2015 (KR) ..... 10-2015-0030470

(51) Int. Cl.
*G05F 1/46* (2006.01)
*G05F 1/625* (2006.01)

(52) U.S. Cl.
CPC ..... *G05F 1/625* (2013.01)

(58) Field of Classification Search
CPC ..... G05F 1/46; G05F 1/462; G05F 1/468
See application file for complete search history.

(56) References Cited

U.S. PATENT DOCUMENTS 7,679,345 B1 * 3/2010 Verma ..... G05F 1/575 323/273

FOREIGN PATENT DOCUMENTS

KR 1020020013389 A 2/2002
KR 1020120037887 A 4/2012

* cited by examiner

*Primary Examiner* — Jeffrey Zweizig
(74) *Attorney, Agent, or Firm* — William Park & Associates Ltd.

(57) ABSTRACT

A trimming circuit may include a code table storing unit configured to store a plurality of test codes, a test voltage generating unit configured to generate test voltages in response to the test codes output by the code table storing unit, and a trimming unit configured to exchange and compare the test voltages and a reference voltage and output first and second pass signals. The trimming circuit may include a code table temporarily storing unit configured to store a test code from among the test codes as a first test code in response to the output of the first pass signal, and store a test code from among the test codes as a second test code in response to the output of the second pass signal, and a calculating unit configured to generate an intermediate code of the first and second test codes as a trimming code.

20 Claims, 4 Drawing Sheets

TRIMMING CIRCUIT AND SEMICONDUCTOR SYSTEM INCLUDING THE SAME

CROSS-REFERENCE TO RELATED APPLICATION

The present application claims priority to Korean patent application number 10-2015-0030470 filed on Mar. 4, 2015, in the Korean Intellectual Property Office, the entire disclosure of which is incorporated by reference herein.

BACKGROUND

1. Technical Field

Various embodiments generally relate to a trimming circuit and a semiconductor system including the same, and more particularly, to a trimming circuit configured for generating a trimming code for setting a voltage.

2. Related Art

A semiconductor system includes a semiconductor device for storing data. The semiconductor system also includes a trimming circuit for generating a trimming code to set a voltage used within the semiconductor device.

The semiconductor device generates voltages having various levels according to the trimming code. The generated voltages are used in various operations, such as a program operation, a read operation, and an erase operation.

While operating in a test mode, the trimming code is generated by the trimming circuit. Ideally, different semiconductor systems generate the same voltage with the same trimming code. However, it is difficult to generate the same voltage with the same trimming code due to electrical differences between the semiconductor systems.

SUMMARY

In an embodiment, there may be provided a trimming circuit. The trimming circuit may include a code table storing unit configured to store a plurality of test codes. The trimming circuit may include a test voltage generating unit configured to generate test voltages in response to the test codes output by the code table storing unit. The trimming circuit may include a trimming unit configured to exchange and compare the test voltages and a reference voltage and output first and second pass signals. The trimming circuit may include a code table temporarily storing unit configured to store a test code from among the test codes as a first test code in response to the output of the first pass signal, and store a test code from among the test codes as a second test code in response to the output of the second pass signal. The trimming circuit may include a calculating unit configured to receive the first and second test codes, and generate an intermediate code of the first and second test codes as a trimming code.

In an embodiment, there may be provided a trimming circuit. The trimming circuit may include a code table storing unit configured to sequentially output test codes until a first pass signal is received, and sequentially output the test codes from a beginning of the test codes again when the first pass signal is received. The trimming circuit may include a test voltage generating unit configured to generate test voltages in response to the test codes. The trimming circuit may include a trimming unit configured to compare the test voltages with a reference voltage, output a first pass signal according to a result of the comparison, exchange and compare the test voltages and the reference voltage when the first pass signal is output, and output a second pass signal according to a result of the comparison. The trimming circuit may include a code table temporarily storing unit configured to store the test code from among the test codes as a first test code in response to the output of the first pass signal, and store a test code from among the test codes as a second test code in response to the output of the second pass signal. The trimming circuit may include a calculating unit configured to output an intermediate code of the first and second test codes as a trimming code.

In an embodiment, there may be provided a semiconductor system. The semiconductor system may include a code table storing unit configured to store a plurality of test codes, and sequentially output the test codes in response to a test mode signal. The semiconductor system may include a test voltage generating unit configured to generate test voltages in response to the test codes. The semiconductor system may include a trimming unit configured to exchange and compare the test voltages and a reference voltage and output first and second pass signals. The semiconductor system may include a code table temporarily storing unit configured to store a test code from among the test codes as a first test code in response to the output of the first pass signal, and store a test code from among the test codes as a second test code in response to the output of the second pass signal. The semiconductor system may include a calculating unit configured to receive the first and second test codes, and generate an intermediate code of the first and second test codes as a trimming code. The semiconductor system may include a semiconductor device configured to store the trimming code, and generate a target voltage according to the trimming code when performing a selected operation, and perform the selected operation.

DETAILED DESCRIPTION

Hereinafter, various examples of embodiments will be described below with reference to the accompanying drawings. However, the embodiments are not limited to embodiments to be disclosed below, but various forms different from each other may be implemented.

Due to the problems discussed above, it may be necessary to search for trimming codes for generating target voltages, respectively, according to the semiconductor system.

Various embodiments may provide a trimming circuit capable of accurately generating a trimming code corresponding to a target voltage, and a semiconductor system including the same.

According to an embodiment, it may be possible to rapidly and accurately search for a trimming code corresponding to each target voltage, thereby improving reliability of the semiconductor system.

Figure 1:
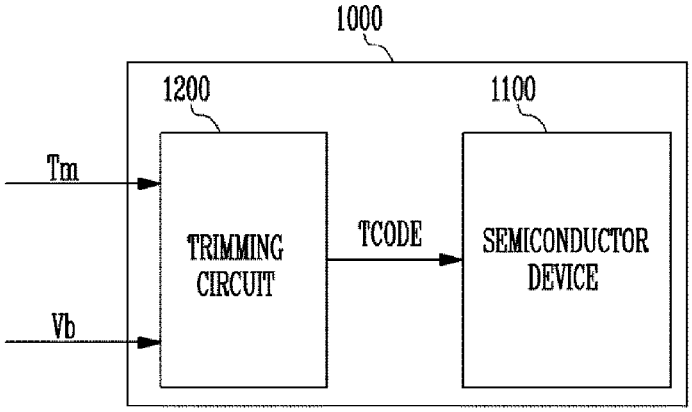
FIG. 1 is a diagram illustrating a representation of an example of a semiconductor system according to an embodiment.

FIG. 1 is a diagram illustrating a representation of an example of a semiconductor system according to an embodiment.

Referring to FIG. 1, a semiconductor system 1000 may include a semiconductor device 1100 and a trimming circuit 1200.

The trimming circuit 1200 may be configured to transmit a trimming code TCODE. The trimming code TCODE may be generated by the trimming circuit 1200 while the trimming circuit 1200 is in a test mode. The trimming code TCODE generated by the trimming circuit 1200 may be received by the semiconductor device 1100. For example, when a test mode signal Tm is received, the trimming circuit 1200 generates a trimming code TCODE corresponding to a target voltage by performing a trimming operation using a reference voltage Vb. Target voltages having various levels are used in various operations, so that the trimming circuit 1200 generates a plurality of trimming codes TCODE corresponding to various target voltages by performing trimming operations corresponding to the target voltages, respectively.

The semiconductor device 1100 may be configured to store the trimming codes TCODE, generate the target voltages according to the stored trimming codes TCODE, and perform program, read, and erase operations by using the generated target voltages. The semiconductor device 1100 may include, for example but not limited to, a Double Data Rate Synchronous Dynamic Random Access Memory (DDR SDRAM), Low Power Double Data Rate4 (LPDDR4) an SDRAM, a Graphics Double Data Rate (GDDR) SDRAM, a Low Power DDR (LPDDR), a Rambus Dynamic Random Access Memory (RDRAM), or a flash memory according to the various examples of embodiments.

Figure 2:
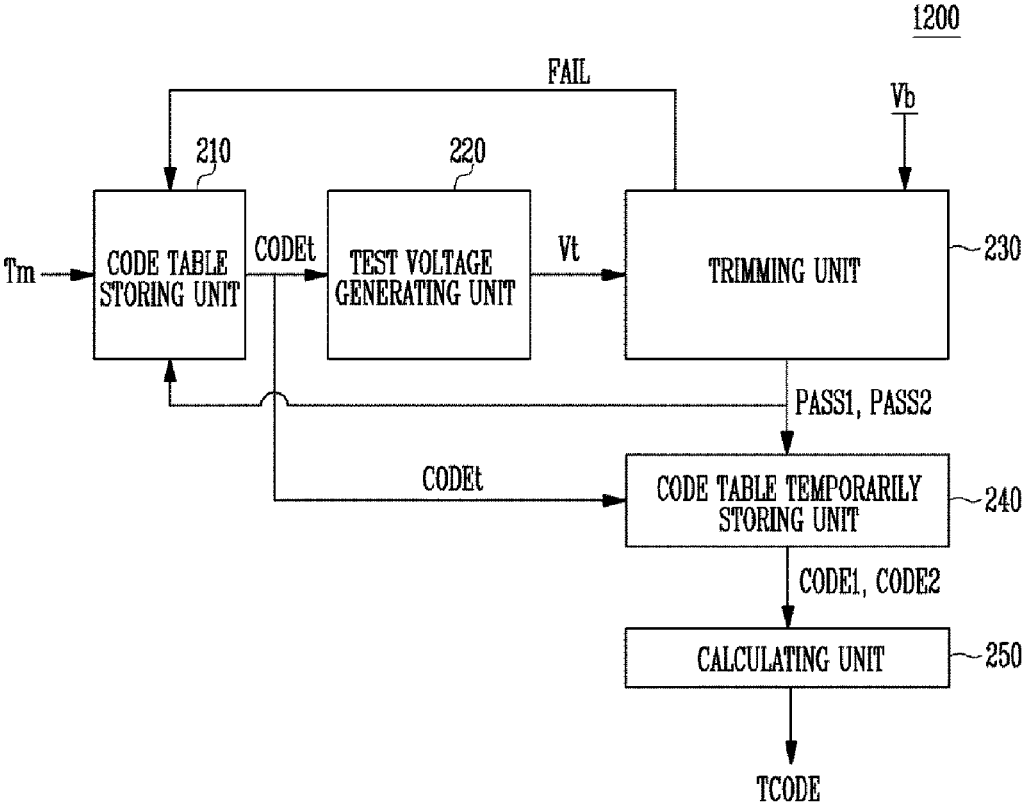
FIG. 2 is a diagram illustrating a representation of an example of a trimming circuit of FIG. 1.

FIG. 2 is a diagram illustrating a representation of an example of the trimming circuit of FIG. 1.

Referring to FIG. 2, the trimming circuit 1200 may include a code table storing unit 210, a test voltage generating unit 220, a trimming unit 230, a code table temporarily storing unit 240, and a calculating unit 250.

Each device included in the trimming circuit 1200 will be described below.

Test codes CODEt are stored in the code table storing unit 210. The code table storing unit 210 may output a selected test code CODEt among the test codes CODEt in response to the test mode signal Tm. The test code CODEt output from the code table storing unit 210 may be transmitted to the test voltage generating unit 220 and the code table temporarily storing unit 240.

The test voltage generating unit 220 may generate a test voltage Vt in response to the test code CODEt. The test voltage Vt may be variously generated according to the test code CODEt. The test code will be described with reference to Table 1 below.

TABLE 1

| Test code CODEt | Test voltage Vt |
|---|---|
| 00000 | 1.058 |
| 00001 | 1.077 |
| 00010 | 1.096 |
| 00011 | 1.116 |
| 00100 | 1.135 |
| 00101 | 1.154 |
| 00110 | 1.165 |
| 00111 | 1.173 |
| 01000 | 1.187 |
| 01001 | 1.192 |
| 01010 | 1.208 |

TABLE 1-continued

| Test code CODEt | Test voltage Vt |
|---|---|
| 01011 | 1.229 |
| 01100 | 1.250 |
| 01101 | 1.271 |
| 01110 | 1.292 |
| 01111 | 1.297 |
| 10000 | 1.314 |
| 10001 | 1.321 |
| 10010 | 1.344 |
| 10011 | 1.368 |
| 10100 | 1.391 |
| 10101 | 1.415 |
| 10110 | 1.438 |
| 10111 | 1.462 |
| 11000 | 1.489 |
| 11001 | 1.516 |
| 11010 | 1.542 |
| 11011 | 1.569 |
| 11100 | 1.595 |
| 11101 | 1.622 |
| 11110 | 1.648 |
| 11111 | 1.675 |

Referring to Table 1, the test code CODEt may be formed of a plurality of bits. For example, when the test code CODEt is formed of 5 bits, 16 test codes CODEt may be stored in the code table storing unit 210. When the code table storing unit 210 receives the test mode signal Tm, the code table storing unit 210 sequentially outputs selected test codes CODEt among the 16 test codes CODEt. The test voltage generating unit 220 may be configured to generate 16 test voltages Vt according to the test code CODEt.

The trimming unit 230 compares a reference voltage Vb applied from outside the semiconductor system 1000 and the test voltage Vt. When the reference voltage Vb is different from the test voltage Vt, the trimming unit 230, for example, outputs a fail signal FAIL. When the reference voltage Vb is the same as the test voltage Vt, the trimming unit 230 outputs the first or second pass signal PASS1 or PASS2. For example, when the reference voltage Vb is first the same as the test voltage Vt after the test mode starts, the trimming unit 230 outputs the first pass signal PASS1, and when the reference voltage Vb is the same as the test voltage Vt after the first pass signal PASS1 is output, the trimming unit 230 outputs the second pass signal PASS2. Then, when the reference voltage Vb is the same as the test voltage Vt even in the test mode of generating a trimming code TCODE corresponding to another target voltage, the trimming unit 230 outputs the second pass signal PASS2 after outputting the first pass signal PASS1. The fail signal FAIL is transmitted to the code table storing unit 210, and the first and second pass signals PASS1 and PASS2 are transmitted to the code table storing unit 210 and the code table temporarily storing unit 240.

Particularly, the trimming unit 230 compares the reference voltage Vb and the test voltage Vt by using a comparator, in such a manner that in order to cancel out an offset of the comparator according to the semiconductor system, the trimming unit 230 exchanges and applies the reference voltage Vb and the test voltage Vt to the comparator after the first pass signal PASS1 is output to compare the reference voltage Vb and the test voltage Vt.

The code table temporarily storing unit 240 stores each test code CODEt output from the code table storing unit 210 in response to each of the first and second pass signals PASS1 and PASS2. For example, when the code table temporarily storing unit 240 receives the first pass signal PASS1, the code table temporarily storing unit 240 stores the test code CODEt when receiving the first pass signal PASS1 as a first test code CODE1. Next, when the code table temporarily storing unit 240 receives the second pass signal PASS2, the code table temporarily storing unit 240 stores the test code CODEt when receiving the second pass signal PASS2 as a second test code CODE2. For example, the code table temporarily storing unit 240 temporarily stores the first and second test codes CODE1 and CODE2, and outputs the stored first and second test codes CODE1 and CODE2 to the calculating unit 250.

The calculating unit 250 outputs a trimming code TCODE. The calculating unit 250 may output the trimming code TCODE in response to the first and second test codes CODE1 and CODE2. For example, when the calculating unit 250 receives the first and second test codes CODE1 and CODE2, the calculating unit 250 outputs an intermediate code of the first test code CODE1 and the second test code CODE2 as the trimming code TCODE.

The output trimming code TCODE is stored in the semiconductor device 1100 (see FIG. 1), and the semiconductor device 1100 generates target voltages according to the stored trimming codes TCODE and performs a corresponding operation while performing the program, read, or erase operation.

The trimming unit 230 in the trimming circuit 1200 may be variously implemented according to levels of the reference voltage Vb and the test voltage Vt. For example, when the reference voltage Vb and the test voltage Vt are low voltages and high voltages, the trimming unit 230 may be variously implemented according to each voltage characteristic, which will be described with reference to FIGS. 3 and 4.

Figure 3:
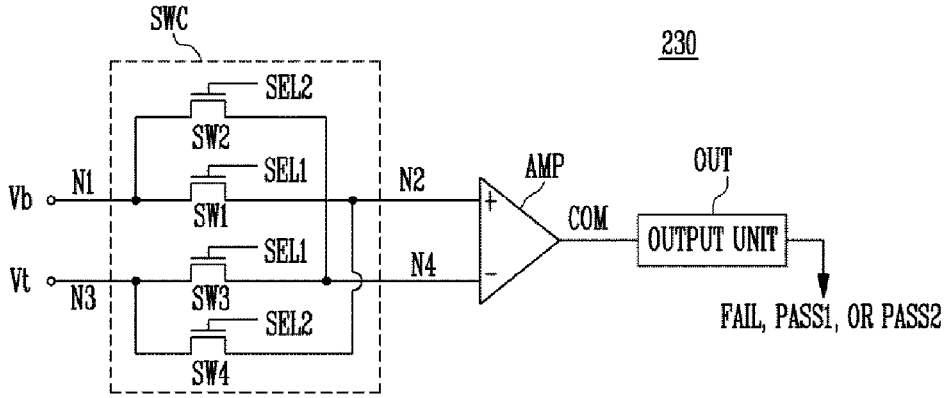
FIG. 3 is a circuit diagram illustrating a representation of an example of a trimming unit according to an embodiment.

FIG. 3 is a circuit diagram illustrating a representation of an example of a trimming unit according to an embodiment.

Referring to FIG. 3, a trimming unit 230 according to an embodiment may be configured to be appropriate for a low voltage. The trimming unit 230 for a low voltage according to the embodiments related to FIG. 3 may include a voltage switching circuit SWC, a comparator AMP, and an output unit OUT.

The voltage switching circuit SWC changes nodes, to which the reference voltage Vb and the test voltage Vt are applied, in response to a first or second selection signal SEL1 or SEL2. Particularly, the voltage switching circuit SWC may include first to fourth switches SW1 to SW4. The first switch SW1 may be implemented by an NMOS transistor connecting a first node N1 and a second node N2 to each other in response to the first selection signal SEL1. The reference voltage Vb is applied to the voltage switching circuit SWC through the first node N1. The second switch SW2 may be implemented by an NMOS transistor connecting the first node N1 and a fourth node N4 to each other in response to the second selection signal SEL2. The third switch SW3 may be implemented by an NMOS transistor connecting a third node N3 and the fourth node N4 to each other in response to the first selection signal SEL1 The test voltage Vt is applied to the voltage switching circuit SWC through the third node N3. The fourth switch SW4 may be implemented by an NMOS transistor connecting the third node N3 and the second node N2 to each other in response to the second selection signal SEL2.

The first selection signal SEL1 may be first applied to the voltage switching circuit SWC, so that the voltage switching circuit SWC may be reset. The first selection signal SEL1 and the second selection signal SEL2 may have different logic values. For example, when the first selection signal SEL1 is logic high, the second selection signal SEL2 is logic low, and when the first selection signal SEL1 is logic low, the second selection signal SEL2 is logic high. The voltage switching circuit SWC is reset according to the high first selection signal SEL1 so that when the test mode starts, the first and third switches SW1 and SW3 are turned on, and the second and fourth switches SW2 and SW4 are turned off. Accordingly, the reference voltage Vb applied through the first node N1 is transmitted to the second node N2 through the first switch SW1, and the test voltage Vt applied through the third node N3 is transmitted to the fourth node N4 through the third switch SW3.

When the logic high second selection signal SEL2 is applied to the voltage switching circuit SWC during the operation in the test mode, the logic high first selection signal SEL1 is transited to be logic low, so that the first and third switches SW1 and SW3 are turned off, and the second and fourth switches SW2 and SW4 are turned off. Accordingly, the reference voltage Vb applied through the first node N1 is transmitted to the fourth node N4 through the second switch SW2, and the test voltage Vt applied through the third node N3 is transmitted to the second node N2 through the fourth switch SW4. The first selection signal SEL1 is maintained in logic high before the first pass signal PASS' is output from the output unit OUT, the second selection signal SEL2 is maintained in logic high after the first pass signal PASS' is output and before the second pass signal PAS2 is output.

The comparator AMP compares the voltages applied to the second node N2 and the fourth node N4, and outputs a comparison signal COM according to a result of the comparison. For example, the second node N2 may be connected to a first input terminal (+) of the comparator AMP, and the fourth node N4 may be connected to a second input terminal (−) of the comparator AMP. When the voltage applied to the second node N2 is higher than the voltage applied to the fourth node N4, the comparator AMP may output the comparison signal COM of logic high. When the voltage applied to the second node N2 is the same as or less than the voltage applied to the fourth node N4, the comparator AMP may output the comparison signal COM of logic low.

Since an electrical characteristic of the comparator AMP may be different according to the semiconductor system, the comparator AMP may generate an offset when comparing the voltages applied to the input terminals (+ and −). However, in an embodiment, the voltages applied to the input terminals (+ and −) of the comparator AMP may be exchanged, so that even though the same test code CODEt is used, the offset may be cancelled out.

The output unit OUT may output the fail signal FAIL, the first pass signal PASS1, or the second pass signal PAS2 in response to the comparison signal COM. The fail signal FAIL output from the output unit OUT may be transmitted to the code table storing unit 210, the first pass signal PASS1 may be transmitted to the code table storing unit 210 and the code table temporarily storing unit 240, and the second pass signal PASS2 may be transmitted to the code table temporarily storing unit 240.

Figure 4:
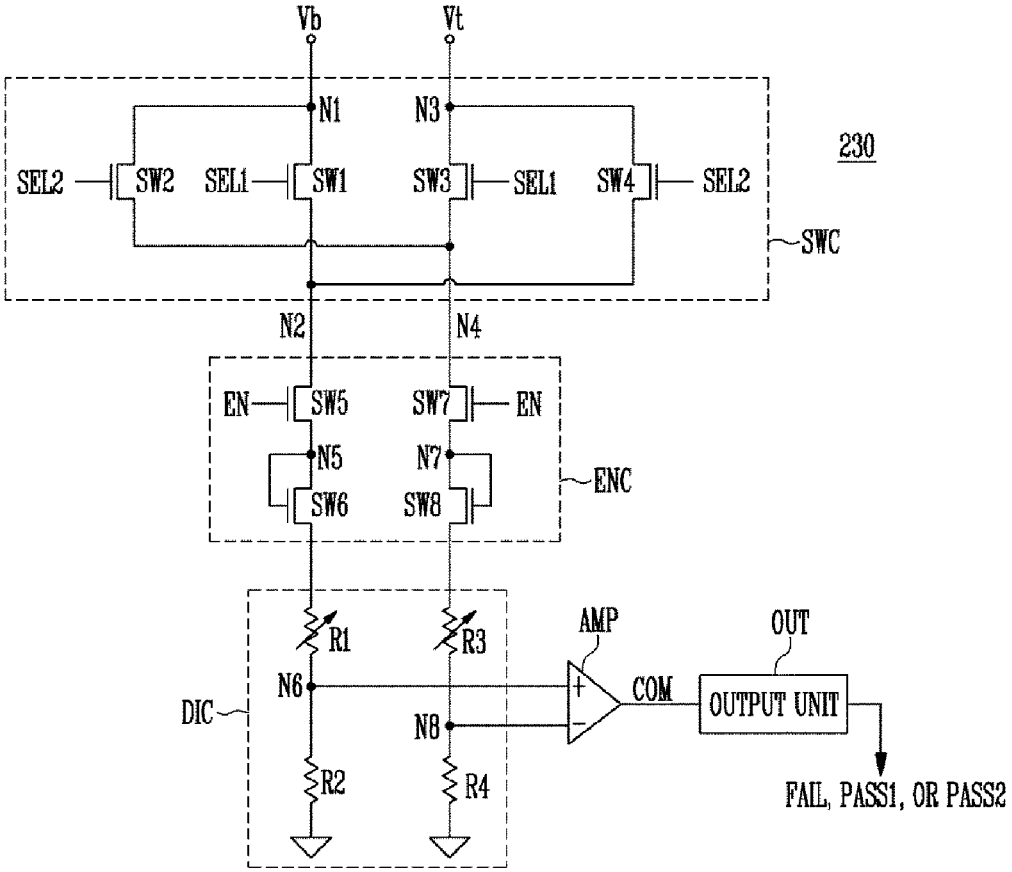
FIG. 4 is a circuit diagram illustrating a representation of an example of a trimming unit according to an embodiment.

FIG. 4 is a circuit diagram illustrating a representation of an example of a trimming unit according to a an embodiment.

Referring to FIG. 4, a trimming unit 230 according to the embodiments relating to FIG. 4 may be configured to be appropriate for a high voltage. A reference of a high voltage and a low voltage may be changed according to a semiconductor system. The trimming unit 230 for a high voltage according to an embodiment may include a voltage switching circuit SWC, an enable circuit ENC, a distribution circuit DIC, a comparator AMP, and an output unit OUT.

The voltage switching circuit SWC changes nodes, to which the reference voltage Vb and the test voltage Vt are applied, in response to a first or second selection signal SEL1 or SEL2. Particularly, the voltage switching circuit SWC may include first to fourth switches SW1 to SW4. The first switch SW1 may be implemented by an NMOS transistor connecting a first node N1 and a second node N2 to each other in response to the first selection signal SEL1. The reference voltage Vb is applied to the voltage switching circuit SWC through the first node N1. The second switch SW2 may be implemented by an NMOS transistor connecting the first node N1 and a fourth node N4 to each other in response to the second selection signal SEL2. The third switch SW3 may be implemented by an NMOS transistor connecting a third node N3 and the fourth node N4 to each other in response to the first selection signal SEL1 The test voltage Vt is applied to the voltage switching circuit SWC through the third node N3. The fourth switch SW4 may be implemented by an NMOS transistor connecting the third node N3 and the second node N2 to each other in response to the second selection signal SEL2.

The first selection signal SEL1 may be first applied to the voltage switching circuit SWC, so that the voltage switching circuit SWC may be reset. The first selection signal SEL1 and the second selection signal SEL2 may have different logic values. For example, when the first selection signal SEL1 is logic high, the second selection signal SEL2 is logic low. For example, when the first selection signal SEL1 is logic low, the second selection signal SEL2 is logic high. The voltage switching circuit SWC may be reset according to the high first selection signal SEL1 so that when the test mode starts, the first and third switches SW1 and SW3 are turned on, and the second and fourth switches SW2 and SW4 are turned off. Accordingly, the reference voltage Vb applied through the first node N1 is transmitted to the second node N2 through the first switch SW1, and the test voltage Vt applied through the third node N3 is transmitted to the fourth node N4 through the third switch SW3.

When the logic high second selection signal SEL2 is applied to the voltage switching circuit SWC during the operation in the test mode, the logic high first selection signal SEL1 is transitioned to a logic low, so that the first and third switches SW1 and SW3 are turned off, and the second and fourth switches SW2 and SW4 are turned off. Accordingly, the reference voltage Vb applied through the first node N1 is transmitted to the fourth node N4 through the second switch SW2, and the test voltage Vt applied through the third node N3 is transmitted to the second node N2 through the fourth switch SW4. The first selection signal SEL1 is maintained in logic high before the first pass signal PASS1 is output from the output unit OUT, the second selection signal SEL2 is maintained in logic high after the first pass signal PASS1 is output and before the second pass signal PAS2 is output.

In an embodiment, the enable circuit ENC may be configured to transmit the voltages applied to the second and fourth nodes N2 and N4 to the distribution circuit DIC in response to the enable signal EN, and may maintain currents of the output nodes of the enable circuit ENC to be uniformly maintained. For example, the enable circuit ENC may include fifth to eighth switches SW5 to SW8. The fifth switch SW5 may be implemented by an NMOS transistor connecting the second node N2 and the fifth node N5 to each other in response to an enable signal EN. The sixth switch SW6 may be implemented by a diode for transmitting the voltage applied to the fifth node N5 to the distribution circuit DIC in response to the voltage applied to the fifth node N5. The seventh switch SW7 may be implemented by an NMOS transistor connecting the fourth node N4 and a seventh node N7 to each other in response to the enable signal EN. The eighth switch SW8 may be implemented by a diode for transmitting the voltage applied to the seventh node N7 to the distribution circuit DIC in response to the voltage applied to the seventh node N7. The diode-type sixth and eighth switches SW6 and SW8 may be used for making a current of a node connecting the enable circuit ENC and the distribution circuit DIC to be uniform.

The distribution circuit DIC may decrease levels of the high voltage output from the enable circuit ENC that are to be used in the comparator AMP and may output the voltages with the decreased levels. For example, the distribution circuit DIC may include first to fourth resistors R1 to R4. The first resistor R1 and the second resistor R2 may be connected, so that a high voltage output from the sixth switch SW6 is distributed and the distributed voltages are output through the sixth node N6. The third resistor R3 and the fourth resistor R4 may be connected, so that a high voltage output from the eighth switch SW8 is distributed and the distributed voltages are output through the eighth node N8. The first and third resistors R1 and R3 may be implemented by variable resistors. For example, the first resistor R1 and the third resistor R3 may be implemented by resistors having the same resistance value, and the second resistor R2 and the fourth resistor R4 may be implemented by resistors having the same resistance value, so that the currents of the sixth node N6 and the eighth node N8 may be the same or substantially the same.

The comparator AMP may compare the voltages applied to the sixth node N6 and the eighth node N8, and may output a comparison signal COM according to a result of the comparison. For example, the sixth node N6 may be connected to a first input terminal (+) of the comparator AMP, and the eighth node N8 may be connected to a second input terminal (−) of the comparator AMP. When the voltage applied to the sixth node N6 is higher than the voltage applied to the eighth node N8, the comparator AMP may output the comparison signal COM of logic high. When the voltage applied to the sixth node N6 is the same as or less than the voltage applied to the eighth node N8, the comparator AMP may output the comparison signal COM of logic low.

Since an electrical characteristic of the comparator AMP may be different according to the semiconductor system, the comparator AMP may generate an offset when comparing the voltages applied to the input terminals (+ and −). However, in an embodiment, after the voltages are applied to the input terminals (+ and −) of the comparator AMP and the comparison signal COM is output, the comparison signal COM is further output by exchanging the voltages applied to the input terminals (+ and −), so that an offset may be cancelled out by calculating the output comparison signals COM.

The output unit OUT may output the fail signal FAIL, the first pass signal PASS1, or the second pass signal PAS2 in response to the comparison signal COM. The fail signal FAIL output from the output unit OUT may be transmitted to the code table storing unit 210, the first pass signal PASS1 may be transmitted to the code table storing unit 210 and the code table temporarily storing unit 240, and the second pass signal PASS2 may be transmitted to the code table temporarily storing unit 240.

Figure 5:
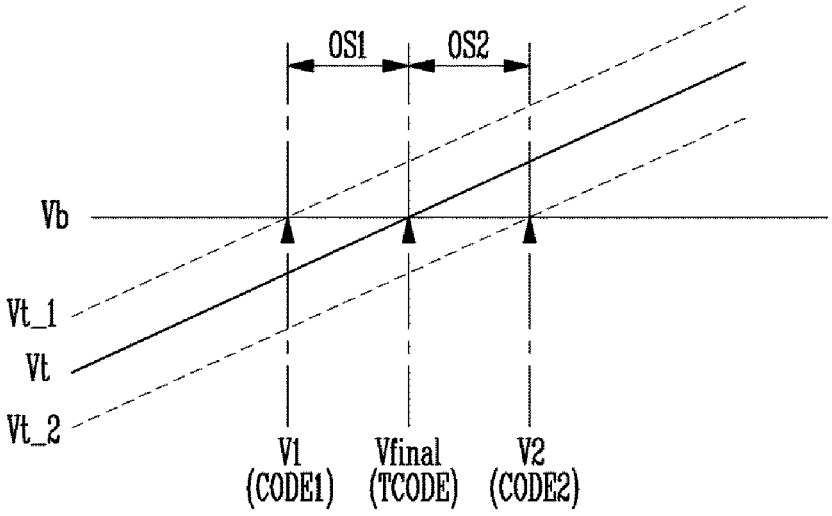
FIG. 5 is a diagram illustrating a representation of an example for describing a method for searching for a trimming code according to an embodiment.

FIG. 5 is a diagram illustrating a representation of an example for describing a method for searching for a trimming code according to an embodiment.

Referring to FIG. 5, when the first and second test codes CODE1 and CODE2 are output from the code table temporarily storing unit 240 (see FIG. 2), the calculating unit 250 (see FIG. 2) outputs an intermediate code obtained by calculating the first and second test codes CODE1 and CODE2 as a trimming code TCODE.

When the first test code CODE1 or the second test code CODE2 has been stored in the semiconductor device 1100

(see FIG. 1), the semiconductor device 1100 may use a first voltage V1, which is lower than a target voltage Vfinal by a first offset OS1 or a second voltage V2, which is higher than the target voltage Vfinal by a second offset OS2, so that the semiconductor device 1100 uses a different voltage from the target voltage Vfinal. In this example, reliability of the semiconductor device 110 may deteriorate. However, as described above, the intermediate code of the first test code CODE1 and the second test code CODE2 is used as the trimming code TCODE, so that the semiconductor device 1100 may use the accurate target voltage Vfinal, thereby improving reliability of the semiconductor device 1100.

An example of a method of searching for the trimming code TCODE will be described below with reference to FIGS. 2 to 5.

When the test mode signal Tm (see FIG. 2) is received in the code table storing unit 210 (see FIG. 2), the code table storing unit 210 outputs a selected test code among the stored test codes CODEt. For example, the test codes CODEt may be selected in an order of '00000', '00001', '00010', . . . , and '11111'. When the test code CODEt is selected and output as '00000', the test voltage generating unit 220 (see FIG. 2) generates a test voltage Vt corresponding to the test code CODEt '00000'. As represented in Table 1, when the test code CODEt is '00000', the test voltage generating unit 220 may output a voltage of 1.058 V. The test code CODEt of Table 1 and the test voltage Vt output in accordance with the test code CODEt may be differently set according to the semiconductor system.

The trimming unit 230 (see FIG. 2) compares the reference voltage Vb and the test voltage Vt. For example, the reference voltage Vb means a voltage having the same level as that of the target voltage Vfinal, and for convenience of the description, it may be assumed that the reference voltage Vb is 1.173 V. When the test voltage Vt is 1.058 V, the test voltage Vt is lower than the reference voltage Vb, so that the trimming unit 230 outputs the fail signal FAIL. The first selection signal SEL1 of logic high is applied to the voltage switching circuit SWC before the trimming unit 230 outputs the first pass signal PASS1. That is, the reference voltage Vb is applied to the first input terminal (+) of the comparator AMP, and the test voltage Vt is applied to the second input terminal (−).

The fail signal FAIL output from the trimming unit 230 is transmitted to the code table storing unit 210, and the code table storing unit 210 outputs a next test code CODEt '00001' in response to the fail signal FAIL. The test voltage generating unit 220 generates the test voltage Vt of 1.077 V in response to the test code CODEt '00001', and the trimming unit 230 compares the sequentially generated test voltage Vt and the reference voltage Vb. When the trimming unit 230 compares the test voltage Vt corresponding to each test code CODEt and the reference voltage Vb while sequentially selecting the test code CODEt by the aforementioned methods, the test voltage Vt and the reference voltage Vb are generated at the same time as illustrated in FIG. 5. However, a first test voltage Vt_1, which is lower than the test voltage Vt by the first offset OS1 due to the first offset OS1 of the comparator AMP (see FIG. 3 or 4) and the reference voltage Vb.

Accordingly, the first pass signal PASS1 is output at a point at which the first test voltage Vt_1 and the reference voltage Vb are the same as each other. For example, when the test code CODEt is '00101', and the first pass signal PASS1 is output from the trimming unit 230, the code table temporarily storing unit 240 (see FIG. 2) temporarily stores '00101' as the first test code CODE1. In this example, the first voltage V1 generated according to the first test code CODE1 is a voltage, to which the first offset OS1 of the comparator AMP (see FIG. 3 or 4) is applied, so that the first voltage V1 is different from the target voltage Vfinal. However, it is impossible to accurately recognize the first offset OS1, so that a subsequent operation is performed by exchanging the voltages applied to the first and second input terminals (+ and −) of the comparator AMP. The subsequent operation will be described below.

After the first pass signal PASS1 is output, the test code CODEt is output again from the beginning, and test voltages Vt are sequentially generated again according to the test code CODEt.

The trimming unit 230 compares the reference voltage Vb and the test voltage Vt, and since the first pass signal PASS1 has been output, the second selection signal SEL2 of logic high is applied to the voltage switching circuit SWC of the trimming unit 120. Accordingly, the test voltage Vt is applied to the first input terminal (+) of the comparator AMP, and the reference voltage Vb is applied to the second input terminal (−). As described above, the exchanged voltages are applied to the first and second input terminals (+ and −) of the comparator AMP, the second offset OS2 contrary to the first offset OS1 may be applied. When the second offset OS2 is applied, contrast to the first test voltage Vt_1, to which the first offset OS1 is applied, the second test voltage Vt_2 higher than the test voltage Vt by the second offset OS2 is compared with the reference voltage Vb.

Accordingly, the second pass signal PASS2 is output at a point at which the second test voltage Vt_2 and the reference voltage Vb are the same as each other. For example, when the test code CODEt is '01001', and the second pass signal PASS2 is output from the trimming unit 230, the code table temporarily storing unit 240 temporarily stores '01001' as the second test code CODE2.

When the first and second test codes CODE1 and CODE2 are stored in the code table temporarily storing unit 240, the calculating unit 250 calculates the first and second test codes CODE1 and CODE2 and generates a code corresponding to a center of the first and second test codes CODE1 and CODE2. The generated code becomes a trimming code TCODE.

The trimming code TCODE generated by the calculating unit is transmitted to the semiconductor device 1100 (see FIG. 1), and the semiconductor device 1100 stores the trimming code TCODE in the storing unit. Then, the semiconductor device 1100 may generate a target voltage according to the trimming code TCODE and perform a corresponding operation when performing the corresponding operation.

As described above, the voltages applied to the input terminals of the comparator AMP are exchanged, and the intermediate code of the generated test codes CODEt is set as the trimming code TCODE, so that it may be possible to rapidly and accurately search for the trimming code TCODE, in which the offset of the comparator is cancelled out. Accordingly, it may be possible to improve reliability of a target voltage generated by the trimming code TCODE, thereby improving reliability of the semiconductor system 1000 (see FIG. 1).

Figure 6:
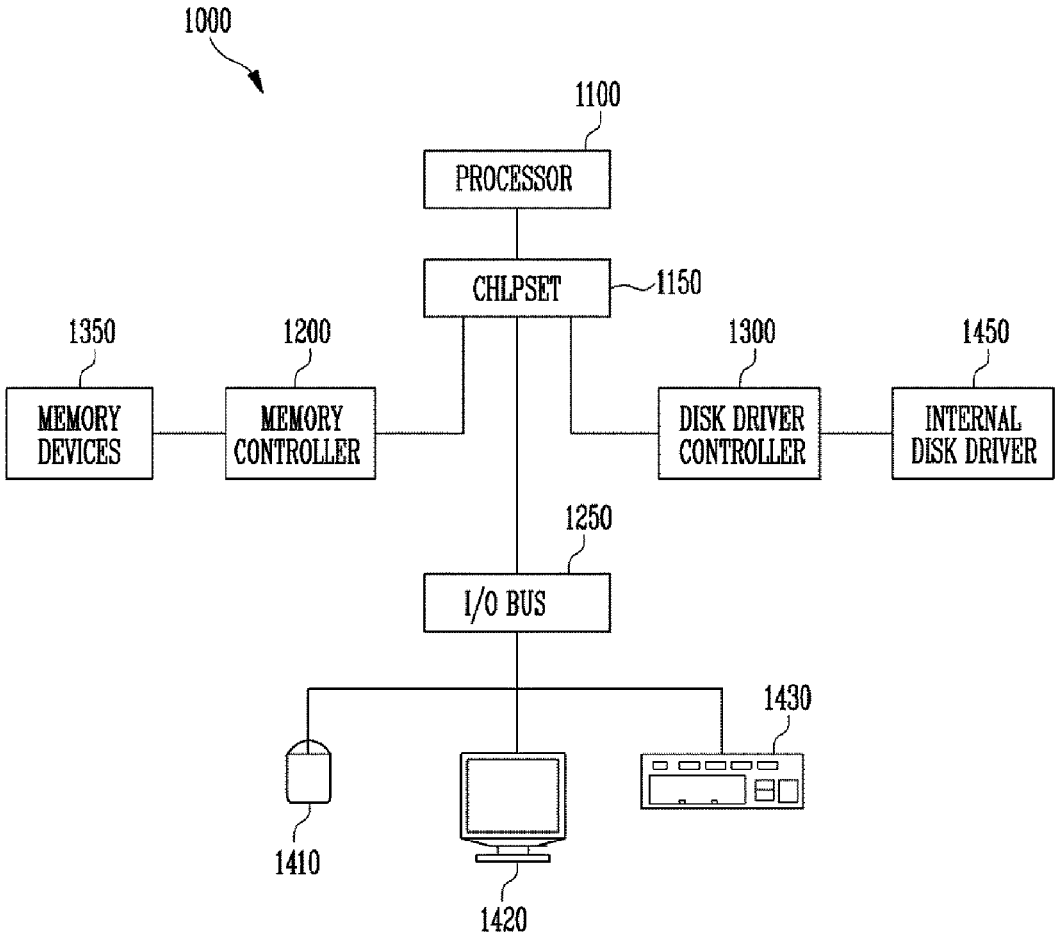
FIG. 6 illustrates a block diagram of an example of a representation of a system employing a semiconductor system and or trimming circuit in accordance with the various embodiments discussed above with relation to FIGS. 1-5.

The trimming circuits and/or semiconductor systems discussed above (see FIGS. 1-5) are particular useful in the design of memory devices, processors, and computer systems. For example, referring to FIG. 6, a block diagram of a system employing a trimming circuit and/or semiconductor system in accordance with the various embodiments are illustrated and generally designated by a reference numeral 1000. The system 1000 may include one or more processors (i.e., Processor) or, for example but not limited to, central processing units ("CPUs") 1100. The processor (i.e., CPU) 1100 may be used individually or in combination with other processors (i.e., CPUs). While the processor (i.e., CPU) 1100 will be referred to primarily in the singular, it will be understood by those skilled in the art that a system 1000 with any number of physical or logical processors (i.e., CPUs) may be implemented.

A chipset 1150 may be operably coupled to the processor (i.e., CPU) 1100. The chipset 1150 is a communication pathway for signals between the processor (i.e., CPU) 1100 and other components of the system 1000. Other components of the system 1000 may include a memory controller 1200, an input/output ("I/O") bus 1250, and a disk driver controller 1300. Depending on the configuration of the system 1000, any one of a number of different signals may be transmitted through the chipset 1150, and those skilled in the art will appreciate that the routing of the signals throughout the system 1000 can be readily adjusted without changing the underlying nature of the system 1000.

As stated above, the memory controller 1200 may be operably coupled to the chipset 1150. The memory controller 1200 may include at least one trimming circuit and/or semiconductor system as discussed above with reference to FIGS. 1-5. Thus, the memory controller 1200 can receive a request provided from the processor (i.e., CPU) 1100, through the chipset 1150. In alternate embodiments, the memory controller 1200 may be integrated into the chipset 1150. The memory controller 1200 may be operably coupled to one or more memory devices 1350. In an embodiment, the memory devices 1350 may include the at least one trimming circuit and/or semiconductor system as discussed above with relation to FIGS. 1-5, the memory devices 1350 may include a plurality of word lines and a plurality of bit lines for defining a plurality of memory cells. The memory devices 1350 may be any one of a number of industry standard memory types, including but not limited to, single inline memory modules ("SIMMs") and dual inline memory modules ("DIMMs"). Further, the memory devices 1350 may facilitate the safe removal of the external data storage devices by storing both instructions and data.

The chipset 1150 may also be coupled to the I/O bus 1250. The I/O bus 1250 may serve as a communication pathway for signals from the chipset 1150 to I/O devices 1410, 1420, and 1430. The I/O devices 1410, 1420, and 1430 may include, for example but are not limited to, a mouse 1410, a video display 1420, or a keyboard 1430. The I/O bus 1250 may employ any one of a number of communications protocols to communicate with the I/O devices 1410, 1420, and 1430. In an embodiment, the I/O bus 1250 may be integrated into the chipset 1150.

The disk driver controller 1300 may be operably coupled to the chipset 1150. The disk driver controller 1300 may serve as the communication pathway between the chipset 1150 and one internal disk driver 1450 or more than one internal disk driver 1450. The internal disk driver 1450 may facilitate disconnection of the external data storage devices by storing both instructions and data. The disk driver controller 1300 and the internal disk driver 1450 may communicate with each other or with the chipset 1150 using virtually any type of communication protocol, including, for example but not limited to, all of those mentioned above with regard to the I/O bus 1250.

It is important to note that the system 1000 described above in relation to FIG. 6 is merely one example of a system 1000 employing a trimming circuit and/or semiconductor system as discussed above with relation to FIGS. 1-5. In alternate embodiments, such as, for example but not limited to, cellular phones or digital cameras, the components may differ from the embodiments illustrated in FIG. 6.

As described above, the embodiments have been disclosed in the drawings and the specification. The specific terms used herein are for purposes of illustration, and do not limit the scope of the present disclosure defined in the claims. Accordingly, those skilled in the art will appreciate that various modifications and another equivalent example may be made without departing from the scope and spirit of the present disclosure. Therefore, the sole technical protection scope of the present disclosure will be defined by the technical spirit of the accompanying claims.

What is claimed is:

1. A trimming circuit, comprising:

a code table storing unit configured to store a plurality of test codes;

a test voltage generating unit configured to generate test voltages in response to the test codes output by the code table storing unit;

a trimming unit configured to exchange and compare the test voltages and a reference voltage and output first and second pass signals;

a code table temporarily storing unit configured to store a test code from among the test codes as a first test code in response to the output of the first pass signal, and store a test code from among the test codes as a second test code in response to the output of the second pass signal; and a calculating unit configured to receive the first and second test codes, and generate an intermediate code of the first and second test codes as a trimming code.

2. The trimming circuit of claim 1, wherein the code table storing unit stores test codes formed of a plurality of bits.

3. The trimming circuit of claim 1, wherein the code table storing unit sequentially outputs the test codes until the first pass signal is output, and when the first pass signal is output, the code table storing unit sequentially outputs the test codes from a beginning of the test codes again.

4. The trimming circuit of claim 1, wherein the trimming unit compares the reference voltage and the test voltages, in such a manner that when the first pass signal is output, the trimming unit exchanges and compares the reference voltage and the test voltages.

5. A trimming circuit, comprising:

a code table storing unit configured to sequentially output test codes until a first pass signal is received, and sequentially output the test codes from a beginning of the test codes again when the first pass signal is received;

a test voltage generating unit configured to generate test voltages in response to the test codes;

a trimming unit configured to compare the test voltages with a reference voltage, output a first pass signal according to a result of the comparison, exchange and compare the test voltages and the reference voltage when the first pass signal is output, and output a second pass signal according to a result of the comparison;

a code table temporarily storing unit configured to store the test code from among the test codes as a first test code in response to the output of the first pass signal, and store a test code from among the test codes as a second test code in response to the output of the second pass signal; and a calculating unit configured to output an intermediate code of the first and second test codes as a trimming code.

6. The trimming circuit of claim 5, wherein the test codes are formed of a plurality of bits.

7. The trimming circuit of claim 5, wherein the code table storing unit sequentially outputs the test codes until the first pass signal is output, and when the first pass signal is output, the code table storing unit sequentially outputs the test codes from the beginning of the test codes again.

8. The trimming circuit of claim 5, wherein the test voltage generating unit outputs the test voltages sequentially increasing according to the test codes.

9. The trimming circuit of claim 5, wherein the trimming unit is implemented by a trimming unit for a low voltage or a trimming unit for a high voltage according to levels of the reference voltage and the test voltages.

10. The trimming circuit of claim 9, wherein the trimming unit for a low voltage includes:

a voltage switching circuit configured to transmit the reference voltage to a first node or a second node, and transmit the test voltage to the second node or the first node in response to a first or second selection signal;

a comparator configured to compare voltages applied to the first node and the second node and output a comparison signal; and an output unit configured to output a fail signal, the first pass signal, or the second pass signal in response to the comparison signal.

11. The trimming circuit of claim 10, wherein the voltage switching circuit includes:

a first switch configured to transmit the reference voltage to the first node in response to the first selection signal;

a second switch configured to transmit the reference voltage to the second node in response to the second selection signal;

a third switch configured to transmit the test voltage to the second node in response to the first selection signal; and a fourth switch configured to transmit the test voltage to the first node in response to the second selection signal.

12. The trimming circuit of claim 11, wherein when the first selection signal is logic high, the second selection signal is logic low, and when the first selection signal is logic low, the second selection signal is logic high.

13. The trimming circuit of claim 9, wherein the trimming unit for a high voltage includes:

a voltage switching circuit configured to transmit the reference voltage to a first node or a second node, and transmit the test voltage to the second node or the first node in response to a first or second selection signal;

a distribution circuit configured to decrease voltages transmitted to the first node and the second node;

a comparator configured to compare voltages output by the distribution circuit, and output a comparison signal; and an output unit configured to output a fail signal, the first pass signal, or the second pass signal in response to the comparison signal.

14. The trimming circuit of claim 13, further comprising:

an enable circuit coupled between the voltage switching circuit and the distribution circuit, and configured to provide uniform current to the distribution circuit.

15. The trimming circuit of claim 14, wherein the enable circuit includes:

a first diode configured to transmit a voltage applied to the first node to the distribution circuit in response to an enable signal; and a second diode configured to transmit a voltage applied to the second node to the distribution circuit in response to the enable signal.

16. The trimming circuit of claim 13, wherein the distribution circuit includes:

a first resistor and a second resistor configured to distribute a voltage applied to the first node; and a third resistor and a fourth resistor configured to distribute a voltage applied to the second node.

17. The trimming circuit of claim 16, wherein the first resistor and the third resistor are formed of variable resistors having substantially the same resistance value, and the second resistor and the fourth resistor are formed of resistors having substantially the same resistance value.

18. A semiconductor system, comprising:

a code table storing unit configured to store a plurality of test codes, and sequentially output the test codes in response to a test mode signal;

a test voltage generating unit configured to generate test voltages in response to the test codes;

a trimming unit configured to exchange and compare the test voltages and a reference voltage and output first and second pass signals;

a code table temporarily storing unit configured to store a test code from among the test codes as a first test code in response to the output of the first pass signal, and store a test code from among the test codes as a second test code in response to the output of the second pass signal;

a calculating unit configured to receive the first and second test codes, and generate an intermediate code of the first and second test codes as a trimming code; and a semiconductor device configured to store the trimming code, and generate a target voltage according to the trimming code when performing a selected operation, and perform the selected operation.

19. The semiconductor system of claim 18, wherein the trimming unit includes:

a voltage switching circuit configured to transmit the reference voltage to a first node or a second node, and transmit the test voltage to the second node or the first node in response to a first or second selection signal; and a comparator configured to compare voltages applied to the first node and the second node and output a comparison signal.

20. The semiconductor system of claim 19, wherein the voltage switching circuit includes:

a first switch configured to transmit the reference voltage to the first node in response to the first selection signal;

a second switch configured to transmit the reference voltage to the second node in response to the second selection signal;

a third switch configured to transmit the test voltage to the second node in response to the first selection signal; and a fourth switch configured to transmit the test voltage to the first node in response to the second selection signal.

* * * * *